US005279349A

United States Patent [19]

Horimura

[11] Patent Number: 5,279,349

[45] Date of Patent: Jan. 18, 1994

[54] PROCESS FOR CASTING AMORPHOUS ALLOY MEMBER

[75] Inventor: Hiroyuki Horimura, Saitama, Japan

[73] Assignee: Honda Giken Kogyo Kabushiki Kaisha, Tokyo, Japan

[21] Appl. No.: 960,242

[22] Filed: Oct. 13, 1992

Related U.S. Application Data

[63] Continuation of Ser. No. 632,038, Dec. 21, 1990, abandoned.

[30] Foreign Application Priority Data

Dec. 29, 1989 [JP] Japan ..... 1-344176

[51] Int. Cl.[5] ..... B22D 27/09; B22D 27/11

[52] U.S. Cl. ..... 164/120; 164/47; 420/590

[58] Field of Search ..... 164/900, 120, 77, 463, 164/423, 47; 420/590

[56] References Cited

U.S. PATENT DOCUMENTS

| | | | |
|---|---|---|---|
| 3,133,843 | 5/1964 | Scherbner | 164/120 |
| 3,668,748 | 6/1972 | Divecha | 164/120 |
| 3,856,513 | 12/1974 | Chen | 164/480 |
| 3,881,541 | 5/1975 | Bedell | 164/480 |
| 4,212,344 | 7/1980 | Uedaira | 164/423 |
| 4,523,621 | 6/1985 | Ray | 164/475 |
| 4,527,614 | 7/1985 | Masumoto | 164/463 |
| 4,718,475 | 1/1988 | Das | 164/415 |
| 4,854,979 | 8/1989 | Wecker | 164/463 |
| 5,213,148 | 5/1993 | Masumoto | 164/122 |

FOREIGN PATENT DOCUMENTS

| | | | |
|---|---|---|---|
| 2-43317 | 2/1990 | Japan | 164/120 |
| 2156720 | 10/1985 | United Kingdom | 164/120 |

*Primary Examiner*—Richard K. Seidel
*Assistant Examiner*—Rex E. Pelto
*Attorney, Agent, or Firm*—Lyon & Lyon

[57] ABSTRACT

A process for casting an amorphous alloy member comprising the steps of preparing a molten metal from an amorphous alloy composition having a relationship of Tg<Tx between the crystallization temperature Tx and the glass transition temperature Tg, pouring the molten metal into a casting mold, and maintaining the molten metal under a pressed condition until the temperature of the molten metal is brought from a temperature in a molten state to a temperature between the crystallization temperature Tx and approximately the glass transition temperature Tg.

4 Claims, 3 Drawing Sheets

PROCESS FOR CASTING AMORPHOUS ALLOY MEMBER

This is a continuation of co-pending application Ser. No. 07/632,038 filed on Dec. 21, 1990, now abandoned.

BACKGROUND OF THE INVENTION

1. FIELD OF THE INVENTION

The field of the present invention is processes for producing an amorphous alloy member, and particularly, processes for casting a member by use of, as a material, an amorphous alloy having a relationship of $Tg<Tx$ between the crystallization temperature Tx and the glass transition temperature Tg.

2. DESCRIPTION OF THE PRIOR ART

If the molten metal of an amorphous alloy of the type described above is prepared and using such molten metal, a member is cast by utilizing a common casting process, the crystallization advances at the crystallization temperature Tx in the course of solidification of the molten metal, with the result that a member having a high volume fraction of an amorphous layer cannot be produced.

Thereupon, the conventional amorphous alloy member is produced using a technique of forming a green compact in a molding manner from an amorphous alloy powder and then subjecting the green compact to a hot plastic working.

However, the prior art process suffers from the following problem: A relatively small working ratio is employed in the prior art process, because if a larger working ratio is employed in the hot plastic working, the temperature of the green compact may exceed the crystallization temperature Tx. Consequently, the resulting member has a lower strength because the bonding power between the powder particles is smaller, and the density of the member cannot be improved.

SUMMARY OF THE INVENTION

It is an object of the present invention to provide a casting process of the type described above, by which an amorphous alloy member having a higher strength and a higher density can be produced.

To achieve the above object, according to the present invention, there is proposed a process for casting an amorphous alloy member, comprising the steps of preparing a molten metal of an amorphous alloy composition having a relationship of $Tg<Tx$ between the crystallization temperature Tx and the glass transition temperature Tg, pouring the molten metal into a casting mold, and maintaining the molten metal under a pressed condition until the temperature of the molten metal is brought from a temperature in a molten state to a temperature between the crystallization temperature Tx and approximately the glass transition temperature Tg.

If the above process is employed, the molten metal can be pressed uniformly because it is in a gel state at a temperature between the crystallization temperature Tx and approximately the glass transition temperature Tg. In addition, the molten metal is subjected to a cooling effect similar to that provided at an increased cooling speed by such pressing and is also subjected uniformly and sufficiently to a cooling effect from the casting mold. This ensures that the migration of atoms in the molten metal is restrained, permitting an amorphous state to be maintained. This provides a higher strength member having a higher volume fraction of an amorphous phase and an improved density.

However, if the pressing is discontinued at a level within a temperature range higher than the crystallization temperature Tx, the crystallization advances, resulting in a failure to provide a member having a higher volume fraction of the amorphous phase. On the other hand, if the pressing is continued until a temperature in a range lower than the glass transition temperature Tg is reached, it follows that the member in a solid state is pressed. Such pressing contributes little to improvements in the strength and the density of the member.

The above and other objects, features and advantages of the invention will become apparent from a reading of the following description of the preferred embodiment, taken in conjunction with the accompanying drawings.

DESCRIPTION OF THE PREFERRED EMBODIMENT

The material selected to illustrate the present invention is $Mg_{76}Ni_{10}Ce_{10}Cr_4$ (the numeral represents atom %) which is an amorphous magnesium-based alloy (which will be referred to as a Mg-based alloy hereinafter) but the invention is not limited to the use of that material.

Figure 1:
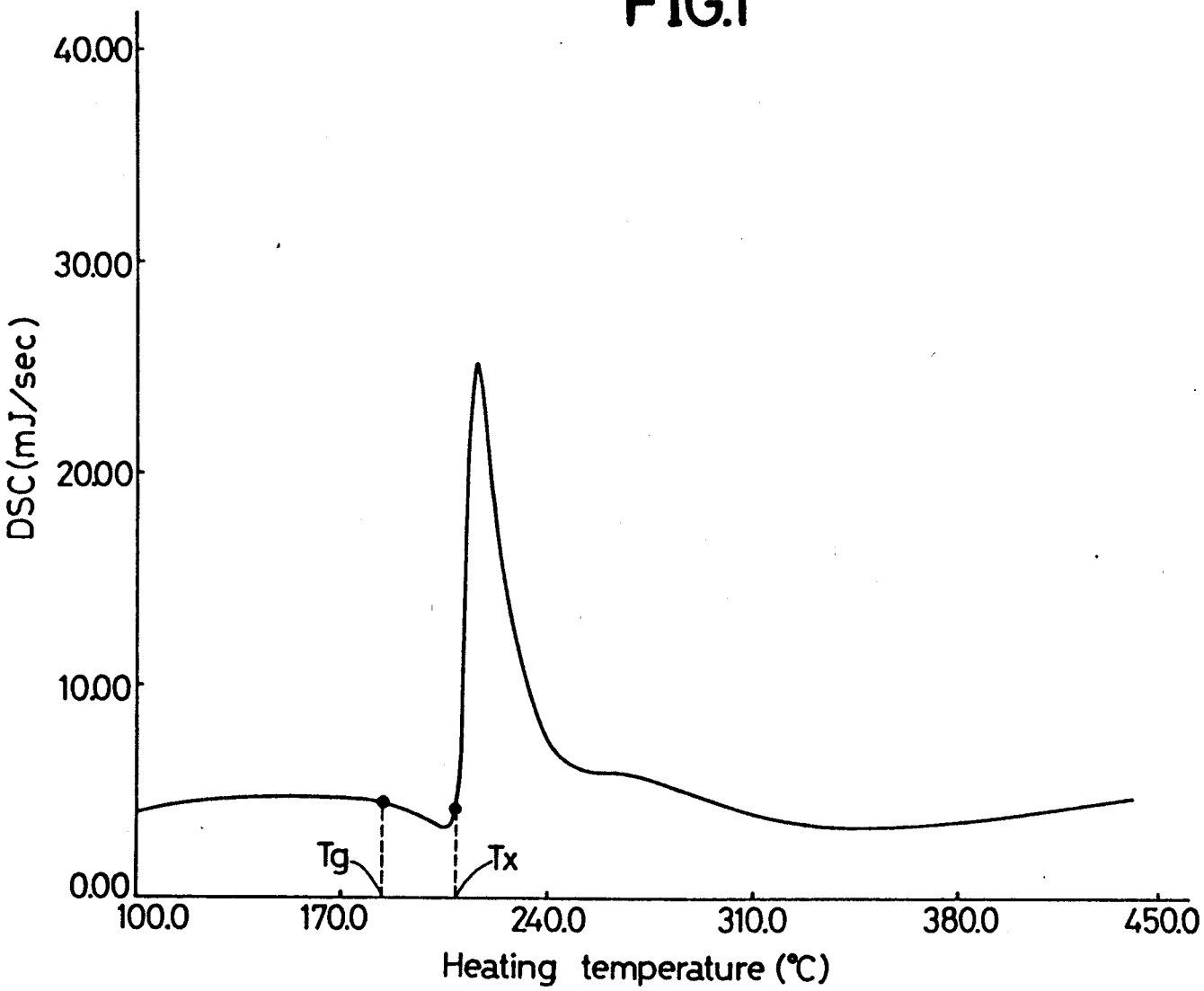
FIG. 1 is a thermocurve diagram of a differential thermal analysis for an amorphous alloy.

FIG. 1 is a thermocurve diagram of a differential thermal analysis for the selected Mg-based alloy. The glass transition temperature Tg of this alloy is 184° C., and the crystallization temperature Tx thereof is 209° C. (i.e., $Tg<Tx$).

Figure 2:
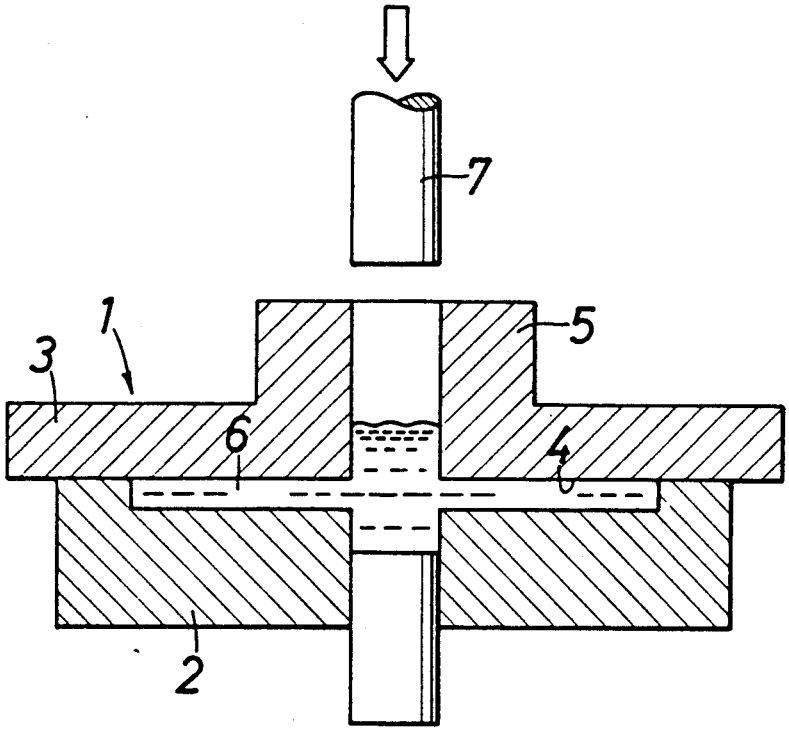
FIG. 2 is a sectional view of a mold.

FIG. 2 illustrates a casting mold (metallic mold) 1 for producing a member. The mold 1 includes a stationary lower die 2 and a vertically movable upper die 3, with a member-molding cavity 4 being defined by the dies 2 and 3. The upper die 3 is provided with a cylinder portion 5 communicating with the cavity 4, and a pressing plunger 7 is adapted to be slidably inserted into the cylinder portion 5 for pressing a molten metal 6 within the cavity 4.

In the casting operation, the mold 1 was preheated to a predetermined temperature, and the molten metal 6 of the Mg-based alloy was prepared.

Then, the molten metal 6 was poured into the cavity 4 in the mold 1 and thereafter, the pressing plunger 7 was slid into the cylinder portion 5 to press the molten metal 6.

Figure 3:
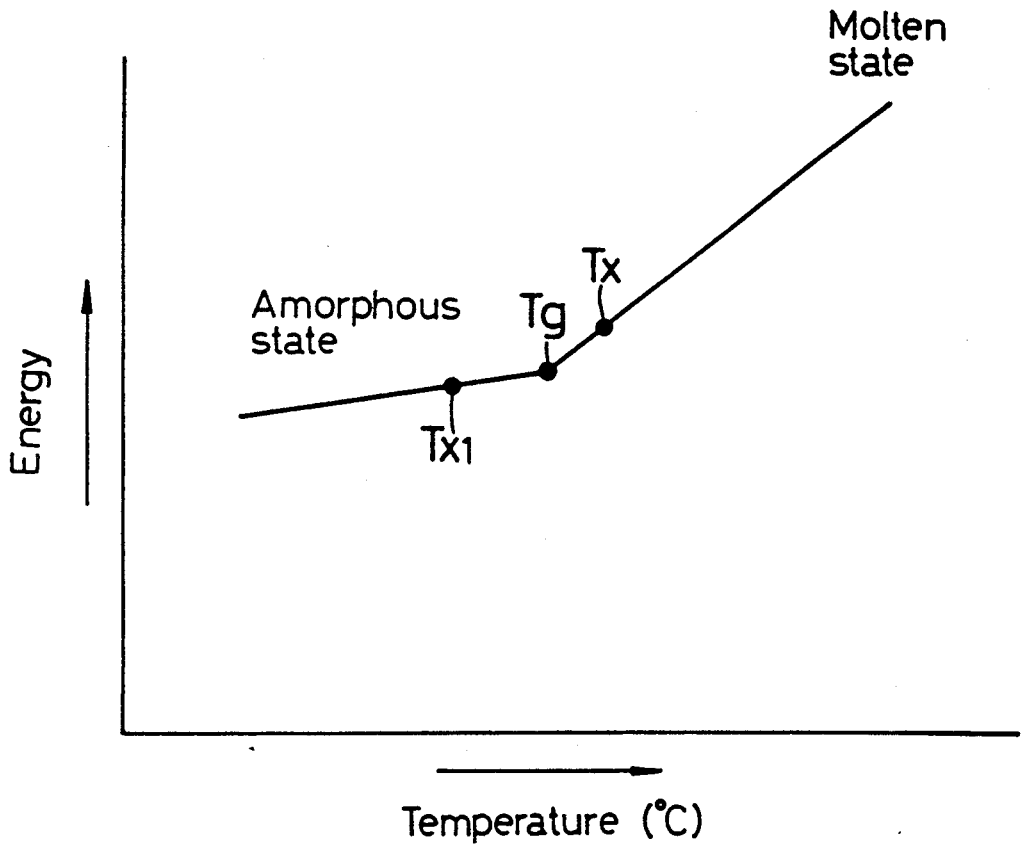
FIG. 3 is a graph illustrating a relationship between the temperature of a molten metal and the energy.

The retention time of pressing of the molten metal 6 was controlled such that the temperature of the molten metal 6 was brought from a temperature in the molten state to a temperature between the crystallization temperature Tx and approximately the glass transition temperature Tg, as shown in FIG. 3. The phrase "approximately the glass transition temperature Tg" means that it includes temperatures near the exact glass transition temperature Tg and temperatures lower than the glass transition temperature.

In this case, for example, the pressing speed of the pressing plunger 7 was set at 10 mm/sec; the pressing force was set at 700 kgf/cm$^2$, and the curing time was 120 seconds.

Table 1 illustrates a relationship between conditions in variation of the above-described casting process and the physical properties of members I to V of the selected Mg-based alloy produced by such process.

TABLE I

| Member No. | P.T. (°C.) | P.C.T. (°C.) | Member Density | Member Vf of A.P. | Member T.S. Kgf/mm$^{2B}$ |
|---|---|---|---|---|---|
| I | 150 | 195 | 99.8 | 78 | 79 |
| II | 150 | 180 | 99.8 | 85 | 83 |
| III | 190 | 195 | 99.8 | 83 | 82 |
| IV | 190 | 180 | 99.8 | 90 | 83.5 |
| V | 190 | 220 | 97.3 | 43 | 50.3 |

P.T. = Preheating temperature of mold
P.C.T. = Temperature at completion of pressing
A.P. = Amorphous phase
T.S. = Tensile strength In Table I, the members I to IV correspond to those produced according to the present invention while member V was produced at a temperature at completion of pressing (P.C.T.) outside the present invention. It can be seen from Table I that the members I to IV each have a higher density, a higher strength and a higher volume fraction Vf of the amorphous phase than member V.

The members I and II were produced when the preheating temperature for the mold was set lower than the glass transition temperature Tg (184° C.), and the members III and IV were produced when the preheating temperature for the mold was set higher than the glass transition temperature Tg. As apparent from a comparison between the members I and II and also between the members III and IV, it is possible to provide excellent physical properties when the temperature at completion of pressing (P.C.T.) is set lower rather than higher, if the same preheating temperature for the mold is used.

As also is apparent from a comparison between the members I and III and between the members II and IV, it is possible to provide excellent physical properties when the preheating temperature for the mold is set at a level higher than the glass transition temperature Tg. This is because if the preheating temperature is set at a level as high as 190° C., the glass transition temperature Tg of this Mg-based alloy, a partial cooling of the molten metal 6 by the mold 1 can be avoided.

It can be seen that the member V is inferior in physical properties as compared with the members I to IV, because the temperature at completion of pressing is higher than the crystallization temperature Tx.

It has been ascertained from experiments that if the above-described pressing process is not employed, members having an amorphous structure cannot be produced.

Table II illustrates a relationship between conditions in the prior art process and physical properties of members VI to XIII produced by the prior art process. The members VI to XIII were produced through steps of preparing a powder of the above-described Mg-based alloy by utilizing an atomizing process, forming a green compact in a molding manner from the amorphous powder having a diameter of 26 um or less and by utilizing CIP (Cold Isostatic Pressing), and vacuum-encapsulating the green compact into a can and hot-extruding it.

TABLE II

| Member No. | Tem. (°C.) | Ex.R. (°C.) | Ex.Pr. (kgf/mm$^2$) | Member density (%) | Member VF of A.P. (%) | Member T.S kgf/mm$^B$ |
|---|---|---|---|---|---|---|
| VI | 195 | 4 | 43 | 92 | 91 | 51 |
| VII | 195 | 7 | 58 | 94 | 40 | 53 |
| VIII | 195 | 9 | 80 | 97 | 12 | 53 |
| IX | 195 | 13 | 95 | 98 | 5 | 50 |
| X | 205 | 4 | 38 | 94 | 46 | 49 |
| XI | 205 | 7 | 51 | 95 | 20 | 54 |
| XII | 205 | 9 | 72 | 97 | 5 | 52 |
| XIII | 205 | 13 | 84 | 98 | 0 | 41 |

Tem. = Temperature of green compact
Ex.R. = Extrusion ratio
Ex.Pr. = Extrusion pressure
A.P. = Amorphous phase
T.S. = Tensile strength As is apparent from a comparison of Tables I and II, it can be seen that the members I to IV produced according to the present invention each have excellent physical properties as compared with the members VI to XIII produced by the prior art process.

Of the members VI to XIII produced by the prior art process, those produced at a lower extrusion ratio are of lower densities and are of lower strengths even if the volume fraction of the amorphous phase is high, because of a weaker bonding power between the powder particles. On the other hand, those produced at a higher extrusion ratio each have a lower volume fraction of the amorphous phase, attendant with a reduced strength, because the temperature of the powder compact has exceeded the crystallization temperature Tx during the hot extrusion.

The tensile strength of a ribbon material of a Mg-based alloy as measured by a single roll method is 84 kgf/mm$^2$, but the strength of each of the above members VI to XIII is substantially lower than that of the ribbon material.

The pressing force on the molten metal in the present invention is controlled to 20 kgf/cm$^2$ or more when it is applied by the pressing plunger 7, or to 10 kgf/cm$^2$ or more when it is applied by a gas. For the casting process, a pressure casting process such as a die-casting process and the like can be utilized in addition to the molten metal forging process used in the above embodiment.

It should be noted that an amorphous alloy having a relationship of Tg>Tx1 (FIG. 3) between its crystallization temperature Tx1 and the glass transition temperature Tg is not included in the materials which may be used in the present invention. The reason is that such an alloy must be maintained under a pressed condition until a temperature equal to or less than the crystallization temperature Tx1 is reached. This means that the material would be in its solid state while being pressed and hence, a uniformly pressing condition cannot be produced.

What is claimed is:

1. A process for casting an amorphous alloy member, comprising the steps of preparing a molten metal from an amorphous alloy having a crystallization temperature Tx and a glass transition temperature Tg with a relationship of Tg≦Tx therebetween, preheating a casting mold to a temperature below the crystallization temperature Tx, pouring said molten metal into said casting mold, and applying a pressure to the molten metal in said casting mold and maintaining said molten metal under said pressure until the temperature of said molten metal is cooled by said casting mold at a rate less than $10^{5}$° C./sec from a temperature in the molten state to a temperature between the crystallization temperature Tx and approximately the glass transition temperature Tg of said amorphous alloy, and thereafter cooling the solidified cast amorphous alloy to room temperature to form a microstructure including an amorphous structure.

2. A process for casting an amorphous alloy member according to claim 1, wherein said casting mold is preheated to a temperature at least as high as the glass transition temperature Tg of said amorphous alloy.

3. A process for casting an amorphous alloy member according to claim 1, wherein said casting mold is a metallic mold.

4. A process for casting an amorphous alloy member according to claim 2, wherein said casting mold is a metallic mold.

* * * * *